United States Patent [19]

Moys et al.

[11] Patent Number: 4,804,460

[45] Date of Patent: Feb. 14, 1989

[54] COLUMN FLOTATION

[75] Inventors: Michael H. Moys, Johannesburg, South Africa; James A. Finch, Montreal, Canada

[73] Assignee: Royal Inst. for Advancement of Learn., A.K.A. (McGill Univ.), Montreal, Canada

[21] Appl. No.: 162,457

[22] Filed: Mar. 1, 1988

[30] Foreign Application Priority Data

Jan. 8, 1988 [CA] Canada ..... 556151

[51] Int. Cl.[4] ..... B03D 1/02

[52] U.S. Cl. ..... 209/164; 209/1; 73/295

[58] Field of Search ..... 209/1, 164, 166, 167; 210/742, 703, 149; 73/295

[56] References Cited

U.S. PATENT DOCUMENTS

| | | | |
|---|---|---|---|
| 3,255,882 | 6/1966 | McCarty | 209/164 |
| 3,474,902 | 10/1969 | Putman | 209/166 |
| 3,551,897 | 12/1970 | Cooper | 209/166 |
| 3,923,655 | 12/1975 | McKinney | 210/149 |
| 4,423,629 | 1/1984 | Ara | 73/295 |
| 4,449,404 | 5/1984 | Bohme | 73/295 |

FOREIGN PATENT DOCUMENTS

| | | | |
|---|---|---|---|
| 501769 | 4/1976 | U.S.S.R. | 209/164 |
| 558695 | 5/1977 | U.S.S.R. | 209/166 |
| 1036381 | 8/1983 | U.S.S.R. | 209/164 |
| 1150034 | 4/1985 | U.S.S.R. | 209/164 |
| 1169751 | 7/1985 | U.S.S.R. | 209/164 |

*Primary Examiner*—Kenneth M. Schor
*Assistant Examiner*—Thomas M. Lithgow
*Attorney, Agent, or Firm*—Neil F. Markva

[57] ABSTRACT

In the froth flotation of ore in a column, the froth/pulp interface level and the efficiency of the froth washing operation are controlled by determining a profile of temperatures measured in the froth layer and slurry below the interface. Temperatures are measured with temperature sensing elements immersed in the froth layer and extending to below the interface level. The measured profile is compared with a target profile and deviations are corrected by changing the tailings flowrate or the washwater flowrate to return a measured profile to the target profile. An inflection point in the profile occurs at the interface level. The inflection point in a measured profile is compared with a level set point, and a deviation from set point value is corrected by increasing or decreasing the flow of tailings whereby the interface level returns to its set point. The washwater rate is controlled by measuring the slope or the position of a measured temperature profile and comparing the measured slope or position with the slope or position of a target profile, i.e. slope or position set point, and a deviation from set point value is corrected by increasing or decreasing the flow of washwater. The washwater distribution is controlled by measuring the concentrate temperature at a plurality of points at the concentrate overflow, comparing each measured temperature with a set point value, and a deviation from set point value is corrected by adjusting the distribution of washwater. A programmed computer may be used for calculating profiles, comparing measured values with set point values and sending a signal for controlling washwater rate or distribution or tailings flow when the deviation of measured values exceeds set point values by a predetermined amount.

27 Claims, 2 Drawing Sheets

COLUMN FLOTATION

This invention relates to improvements in froth flotation and, more particularly, to a process for control of washwater additions, washwater distribution and of the froth/pulp interface in column flotation cells.

BACKGROUND OF THE INVENTION

Froth flotation for the separation of a mineral from its ore may be carried out by hydraulic-pneumatic means using vertically elongated cells or columns. A feed of an aqueous pulp of suitably ground ore and conditioned with reagents as required is supplied at a feed point situated some distance below the top of the column. A gas, usually air, is sparged into the bottom portion of the column. Reagents such as collectors, frothers, activators, depressants and the like may be used. The sparged air bubbles rise in the column, adhere to conditioned mineral particles and the mineral collects in a froth layer which forms in the upper portion of the column, while the gangue materials or tailings displace downwardly in the column into its lower portion. The gangue materials are removed as tailings from the bottom of the column. The froth layer wherein the mineral becomes concentrated also contains an amount of entrained gangue materials. To improve the separation of gangue from mineral the froth layer is washed with an amount of washwater distributed onto or in the froth layer. The washed froth overflows from the top of the column and the mineral is recovered as a concentrate.

In order for the separation to be carried out in an efficient manner it is necessary to control one or more parameters which may include both physical and chemical variables such as the flows of feed, concentrate and tailings, reagents additions, pulp level and density, air and wash water additions, pH, and the pulp/froth interface level.

One of the important parameters is the pulp/froth interface level. Two separate zones exist in a flotation column, namely, an upper or cleaning zone essentially containing the froth layer and a lower or collecting zone wherein gangue materials sink to the bottom and the rising air bubbles attach to the conditioned mineral particles taking them upward into the froth. The two zones are separated by a rather distinct interface. The feed slurry is added to the column at a position below the interface that exists between the cleaning and collection zones. If the level of the interface is too high the volume allowed for the froth layer may be too small and washing may not be carried out effectively resulting in a reduction of the concentrate grade. If the level is too low the volume of the collection zone is reduced, froth stability becomes limiting and recovery of mineral will be reduced. Another important variable is the amount of washwater added that is necessary to enhance the removal of gangue entrained with the mineral in the froth layer. Too little washwater gives insufficient washing tending to lower the grade, while too much washwater tends to reduce the recovery.

PRIOR ART

The prior art discloses a number of methods for controlling the pulp/froth interface level by measuring and/or adjusting height, depth or level of the froth layer.

According to U.S. Pat. No. 3,255,882 a probe is adjustably immersed in the froth layer in a flotation cell.

The probe provides resistance to flow of current as a function of the area of the probe in contact with froth. The current controls the operation of a solenoid valve that governs the flow of pulp from the flotation cell and, thereby, the pulp level in the cell.

U.S. Pat. No. 3,471,010 discloses a method for controlling the operation of a flotation machine by sensing the quantity of froth overflow using a pressure variation sensor in air supplied to either an air-bubbler tube that discharges below the fluctuating pulp level, or an electrical capacitance probe that is arranged above the froth overflow lip of the cell.

In U.S. Pat. No. 3,474,902 is described an apparatus for determining the height or depth of froth in a flotation cell.

According to U.S. Pat. No. 3,551,897 a computer is used to calculate a plurality of coefficients that define the operation of a flotation plant, to postulate new operations states, to set means for controlling variables and to maximize operating profit. One of the variables that is controlled is the thickness of the froth layer, which is controlled by measuring the pulp/froth interface level with a level sensing device.

U.S. Pat. No. 4,028,229 relates to froth flotation apparatus including means responsive to changes in the thickness of the froth layer and serving to maintain the thickness at a predetermined value.

According to CA Pat. No. 1 015 869 flotation processes are controlled by means of a computer. Reagent inputs to the cells are mathematically correlated with the weight of ore feed, and control of concentrate and tailings streams is maintained by adjusting the pulp level of the cells upon comparison between the streams composition and the set values therefor. The control of metallurgy by cell pulp level adjustment is achieved by maintaining concentrate grade and tailings grade within specified ranges. Input signals from on-stream analyzer devices to the computer are mathematically correlated by a computer program and impulse signals to pulp level control valves are generated. Pulp level sensing devices in the cells provide computer input signals indicating current pulp levels.

SUMMARY OF THE INVENTION

It has now been discovered that control of column flotation can be carried out by determining a profile of temperatures measured along the height of the column. During flotation in a column cell the concentrate, the pulp in the collection zone and the washwater used for washing the froth layer have temperatures that usually have different values. The concentrate temperature is affected by the washwater temperature, and the washwater temperature affects the temperatures in the froth layer in the cleaning zone. The temperature of the pulp in the collection zone has usually an essentially constant value. It has been found that differences between concentrate temperature, as affected by the washwater temperature, and the pulp temperature can be used to determine and control the interface level between froth layer and pulp. It has also been found that the concentrate, pulp and washwater temperatures can be used to determine and control the washing efficiency of the froth layer.

According to the main aspect of the invention a measured temperature profile is determined and the measured profile is compared with a target profile representing conditions that are desired for the flotation process. Deviations of the measured profile from the target profile are corrected to bring the measured profile into substantial correspondence with the target profile by changing certain process variables.

More specifically, it has been discovered that the difference between the temperature of the concentrate flowing from the top portion of the column and the temperature of the pulp in the collection zone provides a defined indication of the position of the froth/pulp interface. When there exists such a difference, that is, the temperature of the concentrate is either higher or lower than the temperature of the pulp, an inflection point in the profile occurs that corresponds with the position of the froth/pulp interface. Deviation of the inflection point, i.e. interface level, from a predetermined set point is then used to effect a return to the set point by adjusting the tailings flowrate such as by feedback control of the position of the tailings valve.

In a second aspect of the process according to the invention, a continuous measure of the effectiveness of the washing of the froth in a column is obtained by comparing a measured temperature profile with a target profile. The target profile has a unique slope or a unique position. The slope of the target profile is determined by calculating a tangent to the target profile. The slope of the target profile becomes the set point value with which to compare values of slopes of measured temperature profiles. The position of the target profile is represented by calculating the average temperature of the target profile. This average calculated temperature becomes the set point value with which to compare the calculated average of the values of the measured temperatures that are used to form a measured profile. The slope or the position of a measured profile is determined and compared to the set point value of the slope or the position of the target profile. When the value of a measured slope or a measured position deviates from the set point value, the flow of wash water added to the column is adjusted as necessary, such as by feedback control of the washwater valve, to bring the value of the slope or position of the measured profile back to the set point value. In this manner, the best wash water rate is maintained.

In addition, the effectiveness of the washwater distribution cah be determined by measuring the temperature of the concentrate at a plurality of points at which concentrate overflows from the column cell. The distributor or flows of washwater therefrom may be adjusted when a concentrate temperature so measured deviates from a set point value.

It is an object of the invention to provide a process for controlling the level of the froth/pulp interface in froth flotation in a column cell.

It is another object to provide a process for controlling the level of the froth/pulp interface by measuring the inflection point in temperature profiles measured in the froth and pulp in a column flotation cell.

It is a further object to provide a process for controlling the rate at which washwater is added to the froth layer in a column cell.

It is still another object to provide a process for controlling the rate of washwater by measuring the slope of temperature profiles in the froth layer.

It is yet another object to provide a process for controlling the rate of washwater by measuring the position of temperature profiles in the froth layer.

It is yet another object to provide a process for controlling the distribution of washwater added to the froth layer by measuring concentrate temperatures.

These and other objects of the process of the present invention will become apparent from the following detailed description.

Accordingly, there is provided a process for the froth flotation of ores in a column cell comprising an upper cleaning zone containing a froth layer and a lower collection zone containing an aqueous pulp of said ore having a pulp temperature, said froth layer and said pulp having a froth/pulp interface therebetween, feeding an aqueous pulp of ground ore having a feed temperature into the collection zone below said interface, washing said froth layer in the cleaning zone by adding a flow of washwater having a washwater temperature to remove gangue entrained in said froth layer and to obtain a concentrate having a concentrate temperature, recovering said concentrate from the top of said cleaning zone and discharging a flow of tailings from the bottom of said collection zone, said concentrate temperature being different from said pulp temperature, characterized by measuring said concentrate temperature and said pulp temperature; measuring the temperature at a number of points in said froth layer, said interface and said pulp, said number of points being sufficient to allow the formation of a profile of measured temperatures; forming a measured profile of said measured temperatures; establishing a target profile; comparing said measured profile with said target profile; and adjusting said process if said measured profile deviates from said target profile to return said measured profile substantially to said target profile.

The main embodiment of the process includes a first preferred embodiment characterized by determining an inflection point in said measured profile, said inflection point being representative of the level of said interface; comparing the inflection point of said profile with a level set point value representing a desired level of said interface; and adjusting said flow of discharging tailings if said inflection point deviates from said level set point value to return said interface level to said level set point value.

The process of the main embodiment further includes a second preferred embodiment characterized by measuring said washwater temperature; determining a slope for said measured profile, said slope being representative of the flow of added washwater; comparing said slope with a slope set point value representing a desired slope of a temperature profile; and adjusting said flow of washwater if said slope deviates from said slope set point value to return said slope to said slope set point value.

The process of the main embodiment also includes a third preferred embodiment characterized by measuring said washwater temperature; determining a position for said measured profile, said poition being representative of the flow of added washwater; comparing said position with a position set point value representing a desired position of a temperature profile; and adjusting said flow of washwater if said position deviates from said position set point value to return said position to said position set point value.

Preferably, the process is further characterized by normalizing said measured temperatures to obtain normalized temperatures prior to said forming of said profile; and forming said measured profile from normalized temperatures.

According to other preferred embodiments, a computer is used for normalizing temperatures, calculating profiles, inflection points, slopes or positions, comparing calculated values of inflection points, slopes or positions with set point values and providing signals to means for controlling either washwater flow or tailings flow or both to adjust the flows if calculated values deviate from set point values to return interface level, slope or position to the respective set point values.

According to a further preferred embodiment, the process is further characterized by measuring said concentrate temperature at a plurality of points at the top of said cleaning zone, the concentrate temperature measured at such point being indicative of the effectiveness of the distribution of washwater added to said froth layer; comparing each measured concentrate temperature with a concentrate temperature set point value indicative of effective distribution of washwater; and adjusting said distribution of washwater if a measured concentrate temperature deviates from said set point value to return the deviating measured concentrate temperature to said set point value.

Preferably, a computer is used for normalizing continuously measured concentrate temperatures, comparing normalized values to a set point value, generating a signal when a calculated value deviates from the set point value and adjusting the distribution of washwater in response to the signal to return a deviating concentrate temperature to the set point value.

BRIEF DESCRIPTION OF THE DRAWINGS

The invention will now be described in detail with reference to the accompanying drawings wherein.

DETAILED DESCRIPTION OF THE INVENTION

Figure 1:
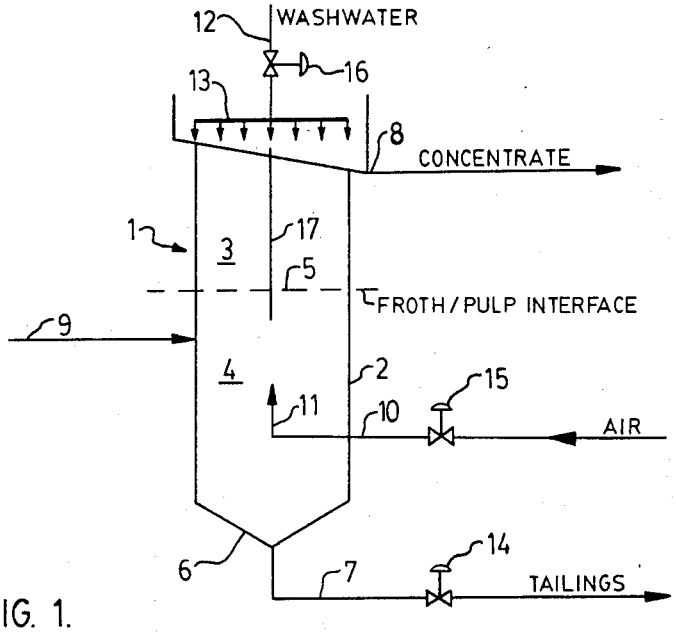
FIG. 1 is a schematic cross section of a column flotation cell with a temperature probe.

With reference to FIG. 1, a column flotation cell, generally indicated at 1, consists of an elongated section 2, usually having a circular or square cross-section, and having an upper portion or cleaning zone 3 and a lower portion or collection zone 4. In the operation of cell 1 the cleaning zone 3 and the collection zone 4 are separated by froth/pulp interface 5. Interface 5 represents a narrow transition zone between froth and pulp and is usually a distinct line. The bottom 6 of column 1 has a discharge line 7 for discharging the tailings from collection zone 4. Cleaning zone 3 has an overflow 8 for discharging the concentrate. Feed is admitted to the column through a feed line 9. Air is fed into collection zone 4 through air line 10. Air line 10 has attached thereto a suitable air sparging device 11 situated in collection zone 4 some small distance from bottom 6. Sparging device 11 is adapted to divide the air flowing through airline 10 into a multitude of small bubbles across the cross section of collection zone 4. Wash water is fed into column cell 1 by means of a wash water feed line 12 with a water distribution device 13 attached to line 12 and positioned at the top of cleaning zone 3 in or above the upper layer of the froth. Water distribution device 13 is situated such that the water sprays from device 13 are either washing the froth layer from above or from within just below the top of the froth layer. Water distribution device 13 is adapted to provide sprays of water that have substantially equal volumes and are evenly distributed over the cross section of the cell 1.

The variables in the froth flotation process carried out in column cell 1 are monitored, regulated and/or recorded by means of control devices. The removal of tailings from cell 1 through tailings line 7 is controlled by means for controlling the flow of discharging tailings, such as flow control valve 14. The flow of air admitted to collection zone 4 through air sparging device 11 is controlled by air flow control valve 15 positioned in air line 10. The flow of washwater admitted to cleaning zone 3 from water distribution device 13 is controlled by means for controlling the flow of washwater such as flow control valve 16 positioned in washwater line 12. Although valves are mentioned as means to control flows, other devices suitable that serve the same purpose may be used.

The process of the invention is similarly suitable for use in rougher flotation and cleaner flotation. The column flotation process is carried out by feeding a slurry of ground ore in water as a pulp of the desired density into column cell 1 through feedline 9. The feed is generally conditioned with a collector for the mineral particles in the pulp. Other chemical substances such as activators, depressants and frothers may be added as required to improve the separation of a concentrate from the tailings during froth flotation. A volume of air is admitted to the pulp through air distribution device 11 and the air flow is controlled with valve 15. Small air bubbles form from device 11 and rise in the column, contact the solids in the feed, attach to the mineral particles, and air and mineral rise from collection zone 4 through the froth/pulp interface 5 to form the froth layer in cleaning zone 3. The froth overflows eventually from the cleaning zone 3 via overflow 8 as the concentrate. The material balance in column cell 1 is maintained by drawing a suitable flow of tailings from the bottom 6 of column 1 through tailings line 7, the flow being controlled by valve 14. When equilibrium has been established the froth layer of the cleaning zone 3 is substantially separated from the pulp in collection zone 4 by froth/pulp interface 5.

To improve the separation of gangue materials from the concentrate, a flow of washwater is evenly distributed from washwater distributor 13 fed by washwater line 12 and controlled by valve 16. The washwater displaces gangue from the froth through interface 5 into collection zone 4, tailings eventually being removed through tailings line 7. The temperatures of the feed, concentrate and washwater are measured with probes installed in feedline 9, at concentrate overflow 8 at one or more points, preferably more than one point, and in washwater line 12, respectively.

According to the invention temperatures are measured at a number of points in the cleaning zone 3 and the collection zone 4 and including interface 5. The measured temperatures are used to form a temperature profile such as, for example, shown with line B in FIG. 2. The temperatures in the cleaning and collection zones and at the interface are conveniently measured, for example as shown in FIG. 1, by inserting a temperature probe 17 into the cell. Temperature probe 17 is preferably an elongated probe having multiple temperature sensing elements (not shown) spaced from each other, preferably equally spaced, along the length of the probe. Probe 17 can be positioned in the cross-section of the cell at any location but is preferably vertically and centrally located. The number of sensing elements in the probe depends on the height of the froth layer in the column and the desired accuracy of the profile. The number should be sufficient to allow the formation of a temperature profile for cleaning zone 3 and the upper portion of collection zone 4, including interface 5. If desired more than one probe positioned in different locations, each with a number of sensing elements, may be used. Temperature sensing elements should be present in the cleaning zone from the top of the froth layer to the interface, at the interface and in the collection zone to at least the lowest level that can be attained by the froth/pulp interface. Temperatures should be measured at points that include at least one point in the top of the froth layer, at least one point at the interface and at least one point in the collection zone just below the lowest level that can be attained by the interface. It is preferred to use a multiplicity of points in the froth layer. It is generally not necessary to have sensing elements farther than just below the interface level, as temperatures in the collection zone are usually substantially constant and generally about equal to the tailings temperature. The sensing elements for temperatures in probe 17 and the sensing elements for temperatures of feed, concentrate and washwater may be temperature transducers, such as thermocouples, thermistors or the like.

Figure 2:
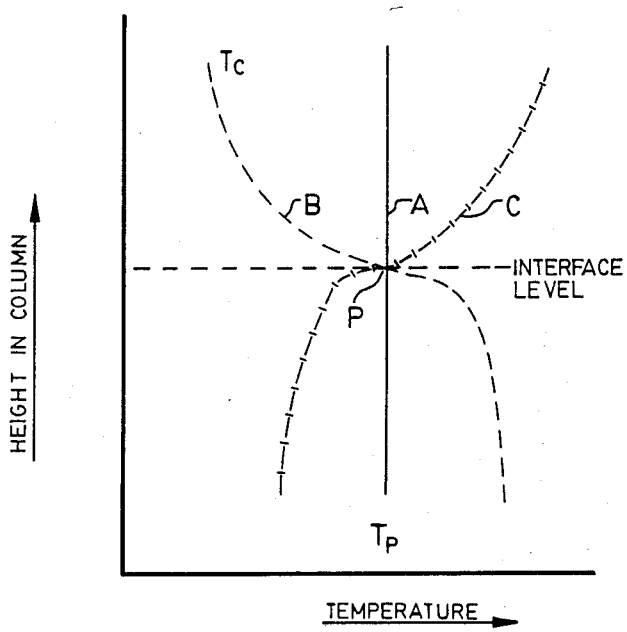
FIG. 2 is a graphical representation of temperature profiles (not to scale) in the cell of FIG. 1.

The temperature profile can be prepared from the measured temperatures and illustrated such as, for example, by plotting temperature versus height in the column as represented by line B in FIG. 2. Preferably, before being used in the preparation of a profile, the temperatures are normalized to compensate for variations that can occur in washwater and feed temperatures. If such variations are not taken into account, the profile could change without any real change occuring in the froth/pulp interface level. Temperature normalization cancels the impact of the variations and avoids making incorrect adjustments to the flotation process. Thus, profiles are preferably plotted and/or calculated based on normalized temperatures. Similarly, the target profile is established based on normalized temperatures. One normalization routine that can be used is based on the following equation:

$$T_N = \frac{T - T_W}{T_F - T_W}$$

wherein $T_N$=normalized temperature, values vary between 0 and 1

T=measured temperature $T_W$=temperature of the washwater $T_F$=temperature of the feed The temperature profile in the column cell is used to control the level of the interface or the flow of washwater added to the froth layer or both. To achieve control, the profile that is measured according to the method described above is compared with a desired or target profile. The target profile is that temperature profile that yields the best compromise between concentrate grade, recovery, tailings density and column throughput. The target profile for a column used for processing a certain ore is readily established by a skilled operator by in-plant testing. When a measured profile deviates from the target profile, the process is adjusted such that the measured profile will substantially be returned to the target profile. The control is exercised by adjusting the flow of tailings from the column or by adjusting the flow of washwater to the froth layer or both. Adjusting is preferably done when a deviation from target occurs that has a value greater than a predetermined value. Adjusting tailings flow and washwater flow can be conveniently achieved by feedback control of tailings valve 14 and washwater valve 16.

According to a first aspect of the invention, when there is a difference between the concentrate temperature $T_C$ and the pulp temperature $T_P$ the profile has an inflection point P that is representative of the level of interface 5. If there is no temperature difference, i.e. concentrate temperature $T_C$ equals pulp temperature $T_P$, the profile is a straight line without an inflection point as shown by line A indicated in FIG. 2. It is noted that the temperature of the pulp in collection zone 4 remains substantially constant.

Inflection point P remains at substantially the same location when the froth/pulp interface remains at the same level, as the tailings temperature is essentially constant. Changes in the level of the interface occur due to changes in such operating variables as feed flow rate, feed grade, air volume and other variables.

The temperature profiles may be graphically displayed and compared with a target profile that includes the inflection point that represents the optimum or desired level of the froth/pulp interface. The desired level is usually determined by evaluating the column performance in the plant. When the froth/pulp interface level rises or falls the inflection point P will deviate from its desired value or level set point value. If a measured profile has an inflection point P, representing a certain froth/pulp interface level, that deviates from the desired level, corrective action may be taken to bring the level back to its level set point value. Any corrective action is usually taken by adjusting the flow of discharging tailings by adjusting the tailings control valve 14. Opening valve 14 lowers interface 5 and closing valve 14 raises interface 5. Adjusting is usually only done when the value of the measured interface level exceeds a predetermined value from the level set point value, i.e., when a deviation from set point value exceeds a predetermined value.

Profile B indicates that the concentrate temperature is below the pulp temperature. It is also possible to operate the process with a concentrate temperature that is above the pulp temperature. An exemplary profile is indicated with C. In the case of no or too small a temperature difference between the concentrate and pulp temperatures, a temperature difference can be readily created by adjusting the temperature of the washwater as will be discussed below. The lowest temperature difference that permits effective control of the interface level is considered to be about 5° C.

According to a preferred embodiment of the invention, the values of temperatures are continuously measured and are fed to a computer that is programmed to normalize the temperatures and to calculate the profile. The computer is operatively connected to the sensing elements for measuring these temperatures. The inflection point in the profile is determined by means of an algorithm. The interface level determined from the calculated profile is compared with the set point that is set either on a set point controller connected to the computer or in a control program in the computer. If the difference between the determined inflection point, i.e. value of the interface level, and the level set point value is greater than a predetermined difference, the set point controller or computer sends a signal to the control means for controlling the flow of discharging tailings to adjust the flow. In practise, the signal is sent to tailings valve 14 that causes valve 14 to open or close as required to adjust the froth/pulp interface level to its set point. The predetermined difference from set point value may, for example, be ±5 cm, but other values for the difference may be used.

According to a second aspect of the invention, the temperature profiles measured in the froth layer are used for determining and controlling the flow of washwater that is to be added for washng of the froth layer. It has been discovered that the slope or, alternatively, the position of the temperature profile is representative of the flow of washwater and is a measure of the effectiveness of the washing of the froth. Whether the slope of a profile or the position of a profile is used to control the effectiveness of froth washing depends on the ore being treated, the apparatus used and the process conditions, and becomes apparent from the shape of measured profiles. The measuring of temperatures, the determination of temperature profiles and the preferred use of normalized temperatures have been described above.

In many cases, the washwater temperature is different from the temperature of the concentrate. Thus, the washwater temperature can be above or below the concentrate temperature.

Figure 3:
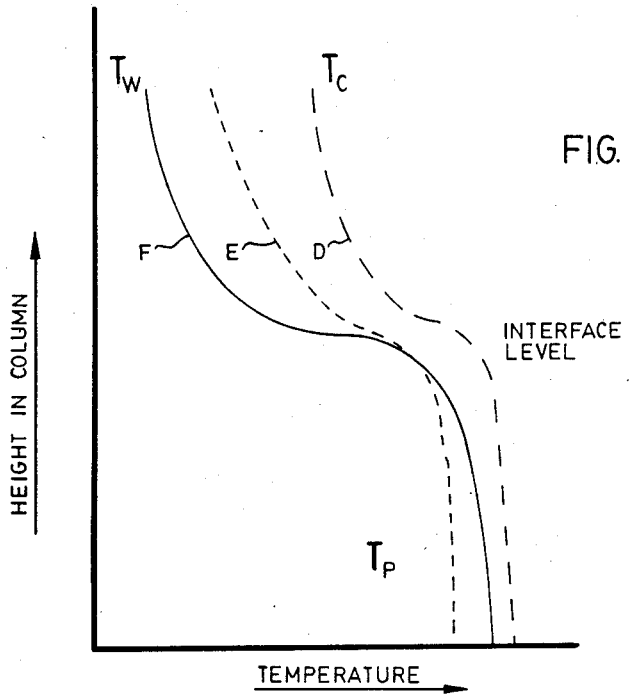
FIG. 3 is a graphical representation of temperature profiles (not to scale) in the cell of FIG. 1 related to wash water.

With reference to FIG. 3, a temperature profile D is shown with a concentrate temperature $T_C$ and a pulp temperature $T_P$, $T_C$ being lower than $T_P$. The washwater temperature is indicated with $T_W$ and is, in this case, lower than the concentrate temperature $T_C$. Profile D represents a profile that is obtained when a certain flow of washwater is used. When the flow of washwater is increased the concentrate temperature will decrease as a result and a temperature profile E will be measured. When the washwater flow is further increased the concentrate temperature will approach the washwater temperature, and ultimately, $T_C$ will equal $T_W$, the corresponding temperature profile being represented by profile F. Conversely, when the washwater flow is decreased the concentrate temperature will increase towards a temperature that ultimately would equal $T_P$, in which case essentially no effective washing occurs.

A similar discussion can be given for when concentrate temperature $T_C$ is higher than pulp temperature $T_P$ and the washwater temperature $T_W$ is higher than concentrate temperature $T_C$. When $T_C$ is higher than $T_P$ temperature profiles will exist to the right of profile A (see FIG. 2).

As can be seen from FIG. 3 profiles D, E and F each have a slope which can be expressed as a tangent to each of the curves. It also follows from FIG. 3 that each of the profiles has a different position that depends on the flow of washwater used. The slope (tangent) or the position of a profile is used to control the flow of washwater added to the column cell. To exercise control a target profile is established, as described above. Once the target profile is determined the slope or the position of the target profile representative of the froth layer in cleaning zone 3 is calculated. The position of a profile is conveniently expressed as the average of the values of the temperatures measured in the froth. Preferably, the temperatures are normalized before being averaged. The calculated slope or position of the target profile is then used as the slope or position set point value against which slopes or positions calculated for other profiles obtained with different flows of washwater are compared. If, upon comparison, values of such measured slopes or positions deviate from the slope or the position set point value, the flow of washwater is adjusted by adjusting washwater valve 16. Valve 16 is adjusted so that the flow of washwater increases or decreases as required to bring the measured calculated slope or position of the temperature profile back to the the slope or the position set point value. The flow of the washwater is usually limited to predetermined maximum and minimum values.

If necessary the temperature of the washwater can be readily adjusted by either cooling or heating the washwater. This may sometimes be necessary to increase or decrease the temperature of the concentrate vis-a-vis the pulp temperature.

According to a preferred embodiment of the invention temperatures are continuously measured, and the temperature profile is calculated with a computer as described above with reference to interface level control. The target profile and its slope or position and the slope or position set-point value are programmed into the computer or set on a set point controller. The value of the slope or position of a measured temperature profile is determined and compared with the slope or position set point value. If the deviation of values of the measured slope or position from the slope or position set point value exceeds a predetermined value, the computer or set point controller sends a signal to the control means for controlling the flow of washwater, e.g. valve 16, that causes the flow to increase or decrease as required. The flow of washwater is adjusted in response to the signal such that a temperature profile will establish itself with a slope or position that has a value substantially equal to the slope or position set point value. The predetermined value of the deviation from slope or position set point value depends on the required sensitivity and may, for example, be within the range of the set-band of the set point controller.

The concentrate grade and the concentrate temperature at a particular point at the concentrate overflow depend on the efficiency of washing that occurs in the froth layer. We have also found that by measuring the temperature of the concentrate at a plurality of points where concentrate overflows from the top of the cleaning zone, i.e. at overflow 8, the effectiveness of the distribution of washwater over or in the froth layer can be determined. To determine concentrate temperatures along overflow 8, a plurality of temperature sensing elements are located at the periphery of or along overflow 8. The measured concentrate temperatures are each compared with a desired concentrate temperature indicative of effective distribution of washwater, and a deviation from the desired value, i.e. concentrate temperature set point value, is used to generate a signal indicating where the distribution of washwater is not effective and requires adjustment. Adjustment may be provided by adjusting a flow of water from the washwater distributor or by adjusting the configuration of the distributor or the like. As with the other embodiments of the invention described above, the temperatures are preferably normalized before being compared with the set point value. Preferably, concentrate temperatures are continuously measured, values of measured concentrate temperatures are fed to a computer, the temperature values are normalized by the computer, each normalized temperature value is compared with a concentrate temperature set point value programmed in the computer, a signal is generated when a deviation of a normalized temperature value exceeds a predetermined value, and the distribution of washwater is adjusted in response to the signal to return a deviating concentrate temperature to the set point value.

It is understood that control of either froth/pulp interface level or washwater addition or washwater distribution or combination thereof may be carried out to control froth flotation in a column cell, either with or without the use of a computer.

The invention will now be illustrated by the following nonlimitative example.

EXAMPLE

The process of the invention was carried out in a column cell having a height of 9.14 m and a square cross-section of 74 by 74 cm. The feed was an aqueous pulp (41% solids) of a finely ground (78% minus 74 micron) lead-zinc-iron ore, containing 66% lead, conditioned with 17 g/tonne of potassium amyl xanthate as collector. The feed had a temperature of 19° C. and was fed to the column at a rate of 9 dry metric tonnes per hour at a point 2.38 m below the concentrate overflow. Air was sparged into the bottom portion of the column at a flow of 1.15 $m^3$/min. Washwater was evenly sprayed on top of the froth layer at 87 l/min. The washwater temperature was 4° C. The tailings flow was 13.9 $m^3$/h and the tailings specific gravity was 1.4. The level of the froth/pulp interface formed at 58 cm below the concentrate overflow level. A 90 cm long temperature measuring probe was inserted into the column. The probe had temperature sensing elements 20, 30, 35, 40, 45, 50, 55, 60, 70 and 89 cm below the froth surface.

After steady state operation of the column was achieved the temperatures measured by the probe were recorded, and were normalized using the equation given above. The normalized temperatures are given in column A of Table I which shows the normalized temperatures against the position of the temperature sensor along the length of the probe measured from the surface of the froth layer. The data of column A form temperature profile K in FIG. 4.

The washwater flow was subsequently changed from 81 l/min to 57 l/min and temperatures were measured and recorded 2 minutes after the washwater volume was changed. The recorded temperatures were normalized and the normalized temperatures are given in column B of Table I and are represented by profile L in FIG. 4. Operation was continued and steady state operation was achieved 12 minutes after changing the washwater flow. Temperatures were again measured and the normalized temperatures are given in column C of Table I and represented by profile M in FIG. 4.

TABLE I

| Temperature Sensor Position from Top of Froth layer in cm | Normalized Temperatures A | B | C | D | E |
|---|---|---|---|---|---|
| 20 | 0.007 | 0.045 | 0.242 | 0.450 | 0.510 |
| 30 | 0.008 | 0.085 | 0.245 | 0.456 | 0.530 |
| 35 | 0.010 | 0.100 | 0.247 | 0.460 | 0.540 |
| 40 | 0.015 | 0.135 | 0.250 | 0.465 | 0.550 |
| 45 | 0.020 | 0.160 | 0.252 | 0.470 | 0.558 |
| 50 | 0.030 | 0.180 | 0.255 | 0.485 | 0.566 |
| 55 | 0.200 | 0.200 | 0.260 | 0.520 | 0.575 |
| 60 | 0.570 | 0.310 | 0.390 | 0.680 | 0.610 |
| 70 | 0.585 | 0.600 | 0.650 | 0.750 | 0.795 |

TABLE I-continued

| Temperature Sensor Position from Top of Froth layer in cm | Normalized Temperatures A | B | C | D | E |
|---|---|---|---|---|---|
| 89 | 0.620 | 0.640 | 0.710 | 0.760 | 0.840 |

The washwater flow was changed once more and reduced from 57 to 38 l/min and temperatures were measured and recorded 4 minutes after changing the washwater flow. The recorded temperatures were normalized and normalized values are given in column D of Table I and represented by profile N in FIG. 4. Steady state was attained 9 minutes after changing the washwater flow and temperatures were measured and recorded. The values for the normalized temperatures are given in column E of Table I and are represented by profile O in FIG. 4.

The grade of the concentrates recorded during the steady state operations as represented by profiles K, M and O was determined and the grades are shown in Table II.

TABLE II

| Profile | Concentrate Grade % Pb | % Zn | % Fe |
|---|---|---|---|
| K | 79.80 | 0.61 | 1.13 |
| M | 78.40 | 1.12 | 1.59 |
| O | 76.80 | 2.10 | 2.26 |

Figure 4:
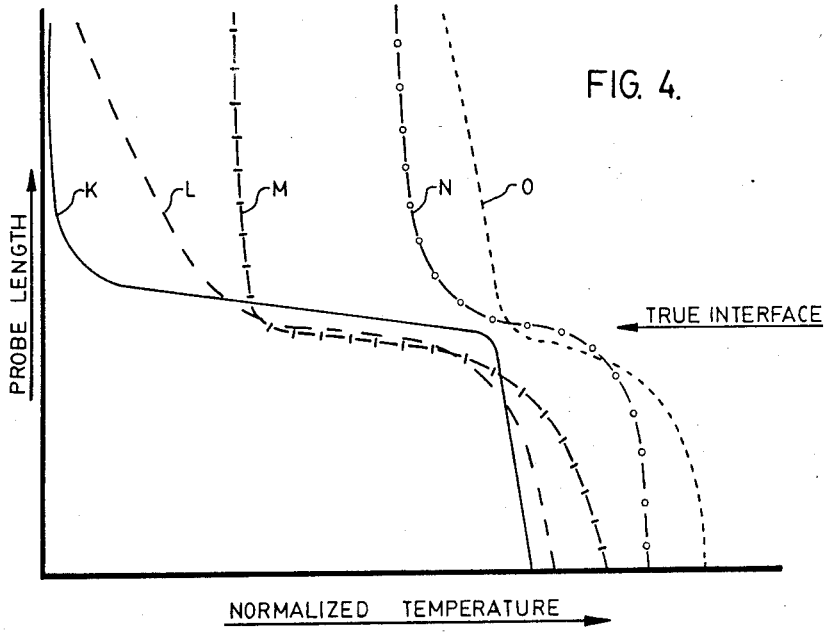
FIG. 4 is a graphical representation of temperature profiles of the Example.

The data given in Table I and illustrated by the profiles in FIG. 4 show that a reduction in the flow of washwater results in an increase in the concentrate temperature and in a change in the position of the measured temperature profile. Comparing the position of a measured profile with a target profile yields an immediate indication whether the flow of washwater should be increased or decreased. The profiles of FIG. 4 also show that the positions of the profiles are readily defined by calculating the average temperature of the temperatures in the froth layer.

The profiles shown in FIG. 4 also show that the profiles are representative of the level of the interface between froth layer and pulp.

The concentrate grades shown in Table II show a decrease in the grade with respect to lead with decreasing flows of washwater. It follows, therefore, that the concentrate grade may be controlled by adjusting the flow of washwater.

Although the invention has been particularly described with reference to preferred embodiments thereof, it will be understood by those skilled in the art that variations and modifications may be made without departing from the scope and spirit of the invention and the appended claims.

We claim:

1. A process for the froth flotation of ores in a column cell comprising an upper cleaning zone containing a froth layer and a lower collection zone containing an aqueous pulp of said ore having a pulp temperature, said froth layer and said pulp having a froth/pulp interface therebetween, wherein said process comprises feeding an aqueous pulp of ground ore having a feed temperature into the collection zone below said interface, washing said froth layer in the cleaning zone by adding a flow of washwater having a washwater temperature to remove gangue entrained in said froth layer and to obtain a concentrate having a concentrate temperature, recovering said concentrate from the top of said cleaning zone and discharging a flow of tailings from the bottom of said collection zone, said concentrate temperature being different from said pulp temperature, the process further comprises measuring said concentrate temperature; measuring the temperature at a number of points in said froth layer, said interface and said pulp; said number of points being sufficient to allow the formation of a profile of measured temperatures; forming a measured profile of said measured temperatures; establishing a target profile; comparing said measured profile with said target profile; and adjusting said process if said measured profile deviates from said target profile to return said measured profile substantially to said target profile.

2. A process as claimed in claim 1, wherein said process further comprises normalizing said measured temperatures to obtain normalized temperatures prior to said forming of said profile; and forming said measured profile from normalized temperatures.

3. A process as claimed in claim 1, wherein said process further comprises determining an inflection point in said measured profile, said inflection point being representative of the level of said interface; comparing the inflection point of said profile with a level set point value representing a desired level of said interface; and adjusting said flow of discharging tailings if said inflection point deviates from said level set point value to return said interface level to said level set point value.

4. A process as claimed in claim 1, wherein said process further comprises measuring said washwater temperature; determining a slope for said measured profile, said slope being representative of the flow of added washwater; comparing said slope with a slope set point value representing a desired slope of a temperature profile; and adjusting said flow of washwater if said slope deviates from said slope set point value to return said slope to said slope set point value.

5. A process as claimed in claim 1, wherein said process further comprises measuring said washwater temperature; determining a position for said measured profile, said position being representative of the flow of added washwater; comparing said position with a position set point value representing a desired position of a temperature profile; and adjusting said flow of washwater if said position deviates from said position set point value to return said position to said position set point value.

6. A process as claimed in claim 3, wherein said process further comprises measuring said temperatures at points that include at least one point at the top of the froth layer, at least one point at the interface and at least one point in the collection zone just below the lowest level that can be attained by the interface.

7. A process as claimed in claim 4, wherein said process further comprises measuring said temperatures at points that include at least one point at the top of the froth layer, at least one point at the interface and at least one point in the collection zone just below the lowest level that can be attained by the interface.

8. A process as claimed in claim 5, wherein said process further comprises measuring said temperatures at points that include at least one point at the top of the froth layer, at least one point at the interface and at least one point in the collection zone just below the lowest level that can be attained by the interface.

9. A process as claimed in claim 3, wherein said process further comprises measuring said temperatures by means of an elongated probe positioned vertically in said cell through said froth layer, interface and into said collection zone, and said temperature probe having multiple sensing elements equally spaced from each other.

10. A process as claimed in claim 4, wherein said process further comprises measuring said temperatures by means of an elongated probe positioned vertically in said cell through said froth layer, interface and into said collection zone, and said temperature probe having multiple sensing elements equally spaced from each other.

11. A process as claimed in claim 5, wherein said process further comprises measuring said temperatures by means of an elongated probe positioned vertically in said cell through said froth layer, interface and into said collection zone, and said temperature probe having multiple sensing elements equally spaced from each other.

12. A process as claimed in claim 3, wherein said process further comprises normalizing said measured temperatures to obtain normalized temperatures prior to said forming of said measured profile; and forming said measured profile from normalized temperatures.

13. A process as claimed in claim 4, wherein said process further comprises normalizing said measured temperatures to obtain normalized temperatures prior to said forming of said measured profile; and forming said measured profile from normalized temperatures.

14. A process as claimed in claim 5, wherein said process further comprises normalizing said measured temperatures to obtain normalized temperatures prior to said forming of said measured profile; and forming said measured profile from normalized temperatures.

15. A process as claimed in claim 3, wherein said adjusting of said flow of discharge failings is done when a deviation from set point value exceeds a predetermined value.

16. A process as claimed in claim 4, wherein said adjusting of said flow of washwater is done when a deviation from set point value exceeds a predetermined value.

17. A process as claimed in claim 5, wherein said adjusting of said flow of washwater is done when a deviation from set point value exceeds a predetermined value.

18. A process as claimed in claim 3, wherein said process further comprises continuously measuring said concentrate temperature, said pulp temperature and the temperature at said number of points; feeding the values of the continuously measured temperatures to a computer operatively connected to means for controlling the flow of the discharging tailings and to sensing elements for measuring said temperatures; normalizing said temperatures, calculating said profile from normalized temperatures and determining said inflection point by means of a program in said computer; comparing the value of said inflection point with a level set point value programmed in the computer; sending a signal from said computer to said means for controlling the flow of discharging tailings to adjust said flow when the deviation of inflection point value from level set point value exceeds a predetermined value; and adjusting said flow of discharging tailings in response to said signal to return said level to said desired level.

19. A process as claimed in claim 4, wherein said process further comprises continuously measuring said concentrate temperature, said pulp temperature, said washwater temperature and the temperature at said number of points; feeding the values of the continuously measured temperatures to a computer operatively connected to means for controlling the flow of washwater and to sensing elements for measuring said temperatures; normalizing said temperatures, calculating said profile from normalized temperatures and determining the slope of the calculated profile by means of a program in said computer; comparing the value of said slope with a slope set point value programmed in the computer; sending a signal from said computer to said means for controlling the flow of washwater to adjust said flow when the deviation of said value of the slope from slope set point value exceeds a predetermined value; and adjusting said flow of washwater in response to said signal to return said value of the slope to said slope set point value.

20. A process as claimed in claim 5, wherein said process further comprises continuously measuring said concentrate temperature, said pulp temperature, said washwater temperature and the temperature at said number of points; feeding the values of the continuously measured temperatures to a computer operatively connected to means for controlling the flow of washwater and to sensing elements for measuring said temperatures; normalizing said temperatures and calculating said profile from normalized temperatures and determining the position of the calculated profile by means of a program in said computer; comparing the value of said position with a position set point value programmed in the computer; sending a signal from said computer to said means for controlling the flow of washwater to adjust said flow when the deviation of the value of said position from position set point value exceeds a predetermined value; and adjusting said flow of washwater in response to said signal to return said value of the position to said position set point value.

21. A process as claimed, in claim 1, wherein said adjusting said process comprises adjusting at least one of the flow of discharging tailings and the flow of washwater to return the measured profile substantially to the target profile.

22. A process as claimed in claim 21, wherein said process further comprises normalizing said measured temperatures to obtain normalized temperatures prior to said forming of said profile; and forming said measured profile from normalized temperatures.

23. A process as claimed in claim 1, wherein said concentrate temperature is measured at a plurality of points at the top of said cleaning zone, the concentrate temperature measured at such point being indicative of the effectiveness of the distribution of washwater added to said froth layer; comparing each measured concentrate temperature with a concentrate temperature set point value indicative of effective distribution of washwater; and adjusting said distribution of washwater if a measured concentrate temperature deviates from said set point value to return the deviating measured concentrate temperature to said set point value.

24. A process as claimed in claim 23, wherein said points of said plurality of points are located at the periphery of or along the overflow for concentrate from said top of the cleaning zone.

25. A process as claimed in claim 23, wherein said process further comprises normalizing said measured concentrate temperatures prior to said comparing with said set point value.

26. A process as claimed in claim 23, wherein said adjusting of said distribution of washwater is done when a deviation from said set point value exceeds a predetermined value.

27. A process as claimed in claim 23, wherein said process further comprises continuously measuring said concentrate temperatures; feeding the values of the continuously measured concentrate temperatures to a computer; normalizing said temperatures; comparing each value of a normalized temperature with a concentrate temperature set point value programmed in the computer; generating a signal when a deviation of a value of a normalized temperature from said set point value exceeds a predetermined value; and adjusting said distribution of washwater in response to said signal to return a deviating concentrate temperature to said concentrate temperature set point value.

* * * * *